US010253960B2

(12) United States Patent
Ocsko

(10) Patent No.: US 10,253,960 B2
(45) Date of Patent: Apr. 9, 2019

(54) RETAINER APPARATUS FOR LUMINAIRE ASSEMBLY

(71) Applicant: GE Lighting Solutions, LLC, East Cleveland, OH (US)

(72) Inventor: Gabor Ocsko, Budapest (HU)

(73) Assignee: GE Lighting Solutions, LLC, East Cleveland, OH (US)

( * ) Notice: Subject to any disclaimer, the term of this patent is extended or adjusted under 35 U.S.C. 154(b) by 119 days.

(21) Appl. No.: 15/379,953

(22) Filed: Dec. 15, 2016

(65) Prior Publication Data

US 2018/0172249 A1 Jun. 21, 2018

(51) Int. Cl.

| | |
|---|---|
| ***F21S 8/02*** | (2006.01) |
| ***F21V 21/04*** | (2006.01) |
| ***F21V 21/088*** | (2006.01) |

(52) U.S. Cl.

CPC ..... *F21V 21/047* (2013.01); *F21S 8/026* (2013.01); *F21V 21/044* (2013.01); *F21V 21/088* (2013.01)

(58) Field of Classification Search

CPC ..... F21V 21/047; F21V 21/088; F21V 21/04; F21V 21/03; F21S 8/02; F21S 8/08; F21S 8/026; Y10T 29/49948

See application file for complete search history.

(56) References Cited

U.S. PATENT DOCUMENTS

| | | | |
|---|---|---|---|
| 4,655,491 A | 4/1987 | Murray | |
| 6,293,510 B1 | 9/2001 | Bradford et al. | |
| 6,505,960 B2 | 1/2003 | Schubert et al. | |
| 8,474,774 B2 | 7/2013 | Svensson | |
| 2005/0207146 A1* | 9/2005 | Reggiani | F21V 21/04 362/150 |
| 2011/0235342 A1* | 9/2011 | Liang | F21V 21/04 362/364 |

(Continued)

FOREIGN PATENT DOCUMENTS

| | | |
|---|---|---|
| CN | 201351840 Y | 11/2009 |
| EP | 2846076 | 3/2015 |
| EP | 3 062 012 A1 | 8/2016 |

(Continued)

OTHER PUBLICATIONS

Extended European Search Report and Opinion issued in connection with corresponding EP Application No. 17206061.8 dated Mar. 6, 2018.

*Primary Examiner* — Joseph L Williams
*Assistant Examiner* — Jose M Diaz
(74) *Attorney, Agent, or Firm* — Peter T. DiMauro; GPO Global Patent Operation

(57) ABSTRACT

The inventive subject matter disclosed herein provides a retainer apparatus for a luminaire assembly. The retainer apparatus includes a spring clamp unit including a clamp element and one or more first springs. The one or more first springs are coupled with the clamp element and the luminaire assembly. The retainer apparatus also includes a lock spring unit comprising a second spring coupled with the luminaire assembly and the clamp element. The second spring of the lock spring unit secures the clamp element in a released position. Responsive to actuation of the second spring, the one or more first springs move the clamp element from the released position to a locked position to secure the luminaire assembly into a recess.

17 Claims, 8 Drawing Sheets

(56) References Cited

U.S. PATENT DOCUMENTS

| | | | | |
|---|---|---|---|---|
| 2015/0330611 | A1* | 11/2015 | Abai | F21V 21/03<br>362/418 |
| 2017/0198870 | A1* | 7/2017 | Wu | F21S 8/026 |

FOREIGN PATENT DOCUMENTS

| | | | |
|---|---|---|---|
| KR | 20-2012-0008713 | U | 12/2012 |
| WO | 2013053768 | | 4/2013 |
| WO | WO 2015058707 | A1 * | 4/2015 |

* cited by examiner

RETAINER APPARATUS FOR LUMINAIRE ASSEMBLY

BACKGROUND

Recessed luminaires are installed in ceiling panels cutouts in the panels. Outer trims of the luminaires may cover space between the cutouts in the panels and the luminaires. The luminaires may fill most of this space, however, which can make it difficult to secure the luminaires in the cutouts. Typically, an object such as a screwdriver must be inserted between the exterior side of the luminaire and the edge of the cutout in the panel to trigger a latch. The latch may engage of the panel to secure the luminaire in the cutout.

Requiring insertion of the object, however, can make installation difficult in situations where there is very little space between the luminaire and the cutout edge. Additionally, the edge of the cutout can be damaged by the object during installation.

BRIEF DESCRIPTION

In one example, the inventive subject matter disclosed herein provides a retainer apparatus for a luminaire assembly. The retainer apparatus includes a spring clamp unit including a clamp element and one or more first springs. The one or more first springs are coupled with the clamp element and the luminaire assembly. The retainer apparatus also includes a lock spring unit comprising a second spring coupled with the luminaire assembly and the clamp element. The second spring of the lock spring unit secures the clamp element in a released position. Responsive to actuation of the second spring, the one or more first springs move the clamp element from the released position to a locked position to secure the luminaire assembly into a recess.

In another example, a retainer apparatus includes a clamp element extending between one or more hook ends and an opposite outer end, one or more first springs coupled with the one or more hook ends of the clamp element and with a housing of a luminaire assembly, and a second spring coupled with the housing of the luminaire assembly and with the outer end the clamp element. The second spring secures the clamp element in a released position. Responsive to actuation of the second spring, the one or more first springs pivot the clamp element from the released position to a locked position to secure the luminaire assembly into a recess.

In another example, a method includes coupling one or more first springs with a housing of a luminaire assembly. The one or more first springs are connected with one or more hook ends of a clamp element. The method also includes coupling a second spring with the housing of the luminaire assembly and with an outer end the clamp element. The second spring is coupled with the housing and with the clamp element such that the second spring secures the clamp element in a released position and such that, responsive to actuation of the second spring, the one or more first springs pivot the clamp element from the released position to a locked position to secure the luminaire assembly into a recess.

DRAWINGS

These and other features, aspects, and advantages of the inventive subject matter will become better understood when the following detailed description is read with reference to the accompanying drawings in which like characters represent like parts throughout the drawings, wherein.

DETAILED DESCRIPTION

One or more embodiments of the inventive subject matter described herein provide retainer apparatuses and methods for simple, rapid, and cost-effective installation of a recessed luminaire assembly into a ceiling panel. One embodiment of the retainer apparatus includes a spring clamp unit and a lock spring unit. The spring clamp unit can include plural torsional coil springs with hooks. The spring clamp unit provides a clamping force to a panel to hold the luminaire assembly in place. The lock spring unit locks the spring clamp in an uppermost (e.g., released) position for installation of the luminaire assembly into a cutout in the panel. The lock spring unit also provide a semi-automatic triggering function to release the spring clamp unit during installation of the luminaire assembly.

Figure 1:
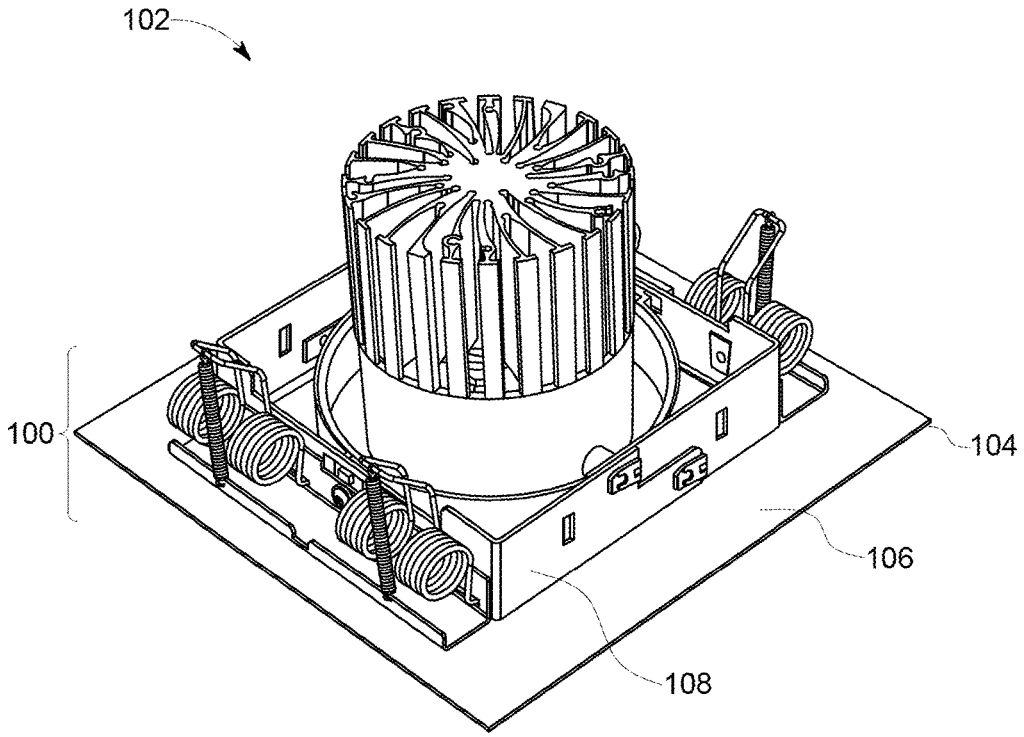
FIG. 1 illustrates a perspective view of one embodiment of retainer apparatuses for a luminaire assembly.

FIG. 1 illustrates a perspective view of one embodiment of retainer apparatuses 100 for a luminaire assembly 102. The luminaire assembly 102 is a recessed luminaire that is inserted into a cutout in a panel, such as a ceiling of a room. The luminaire assembly 102 includes one or more light generating devices (not shown), such as light emitting diodes, fluorescent bulbs, etc. The luminaire assembly 102 includes a panel housing 104 to which the light generating device(s) are joined. The panel housing 104 may be at least partially inserted into the panel cutout, with a lower surface of a frame trim portion 106 of the panel housing 104 being below the panel (and potentially visible from below the luminaire assembly 102). A vertical wall 108 of the panel housing 104 may be inserted into the cutout in the panel and may at least partially extend around the perimeter of the light generating devices.

There are four retainer apparatuses 100 coupled with the housing 104 of the luminaire assembly 102 in the illustrated embodiment. Alternatively, there may be a different number of one or more retainer apparatuses 100 coupled with the housing 104. The retainer apparatuses 100 are connected with the housing 104 in locations that are at least partially or entirely inserted into the cutout in the panel. As a result, the retainer apparatuses 100 are not visible from below the luminaire assembly 102 after installation in one embodiment.

Figure 2:
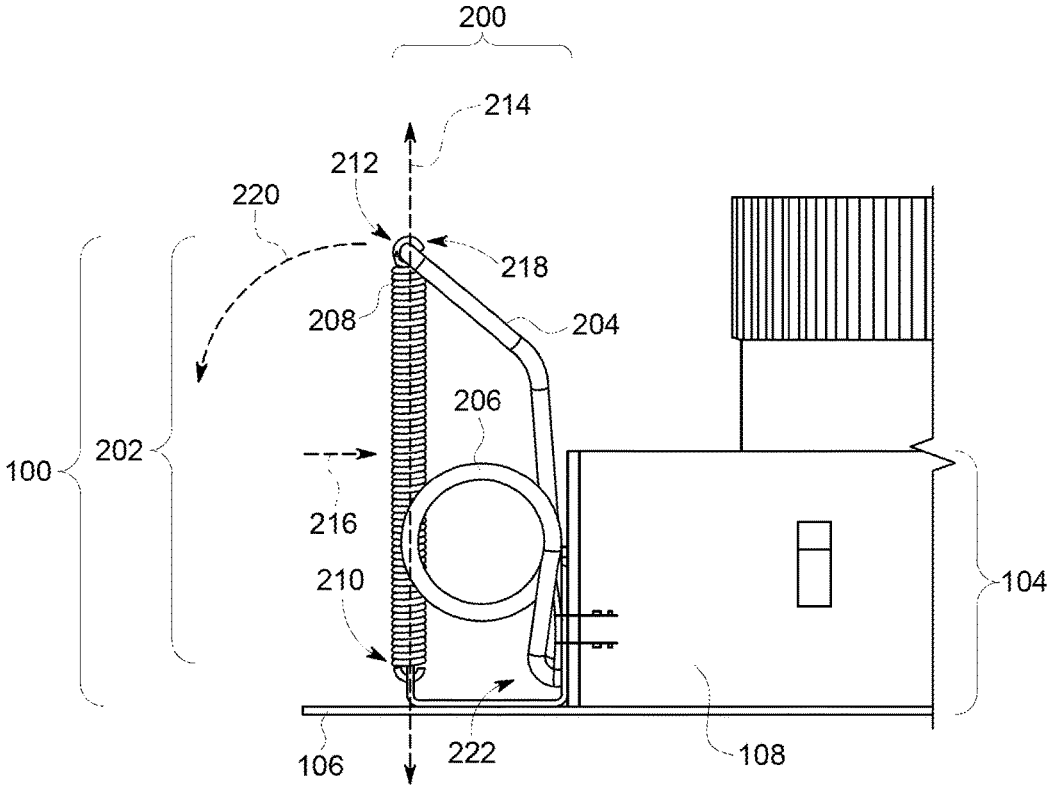
FIG. 2 illustrates a side view of one of the retainer apparatuses shown in FIG. 1 according to one embodiment.

With continued reference to the retainer apparatuses 100 shown in FIG. 1, FIG. 2 illustrates a side view of one of the retainer apparatuses 100 according to one embodiment. The retainer apparatuses 100 shown in FIGS. 1 and 2 are in a released position or state. In this state, the retainer apparatuses 100 are closer to the luminaire assembly 102, such as by being more vertically oriented than when the retainer apparatuses 100 are in a locked position or state described below. The retainer apparatuses 100 may be entirely located within a space or footprint that is smaller than the outer dimensions or footprint of the trim portion 106 of the luminaire housing 104 in one embodiment.

The retainer apparatus 100 includes a spring clamp unit 200 and a lock spring unit 202, as shown in FIG. 2. The spring clamp unit 200 includes an elongated clamp (or clamp element) 204 joined with one or more springs 206. The springs 206 may be torsional coil springs. The clamp element 204 extends from hook ends 222 (which are the ends of the clamp element 204 that are connected with the springs 206). The retainer apparatus 100 shown in FIGS. 1 and 2 includes two springs 206, but optionally may include a different number of one or more springs 206. As shown in FIG. 1, the springs 206 may be on opposite sides of the clamp element 204. The springs 206 are connected with both the clamp element 204 and the housing 104 of the luminaire assembly 100. For example, each of the springs 206 may have one end connected with the vertical wall 108 of the housing 104 and an opposite end connected with the clamp element 204. In one embodiment, the clamp element 204 and the springs 206 for the retainer apparatus 100 are formed as a single continuous body. For example, the clamp element 204 and the springs 206 may be formed from a single length of a wire that is coiled to form the springs 206 and is bent between the springs 206 to form the clamp element 204.

The lock spring unit 200 includes another spring 208 that is coupled with the luminaire assembly 100 and the clamp element 204. The spring 208 of the lock spring unit 200 may be an extension spring having one end 210 coupled with the housing 104 (e.g., the frame portion 106 of the housing 104) of the luminaire assembly 100 and an opposite end 212 coupled with the clamp element 204 in a location between the springs 206 of the spring clamp unit 200. For example, the end 212 of the spring 208 in the spring lock unit 202 may be connected with an outer end 218 of the clamp unit 204. In the illustrated embodiment, the frame portion 106 of the housing 104 includes a vertical extension to which the end 210 of the spring 208 is coupled.

In the released state shown in FIGS. 1 and 2, the springs 206 of the spring clamp unit 200 are in an energized, compressed, or coiled state. The spring 208 of the spring lock unit 202 holds the springs 206 of the spring clamp unit 200 in this compressed state. The springs 206 of the spring clamp unit 200 may apply force onto the clamp element 204, which compresses the spring 208 of the spring lock unit 202 between the clamp unit 204 and the housing 104, as shown in FIG. 2.

The retainer apparatus 100 can transition from the released state or position shown in FIGS. 1 and 2 to a locked state or position by application of a transversely oriented force onto the spring 208 of the spring lock unit 200. The spring 208 of the spring lock unit 202 is elongated along an axial direction or axis 214 extending from one end 210 or 212 to the opposite end 212 or 210 while the retainer apparatus 100 is in the released state shown in FIGS. 1 and 2. A force can be applied along or in a transverse direction 216 that is oriented at an angle to the axial direction 214. The transverse direction 216 is a perpendicular angle in FIG. 2, but optionally may be oriented along an acute angle, obtuse angle, or other angle that is a non-parallel orientation to the axial direction 214.

Application of this force in the transverse direction 216 can cause the spring 208 of the spring lock unit 202 to bend inward, or toward the luminaire assembly 102. Because the spring 208 of the spring lock unit 202 keeps the springs 206 of the spring clamp unit 200 in a compressed, coiled, or energized state while the spring 208 of the spring lock unit 202 remains in a linear shape along the axial direction 214 (as shown in FIGS. 1 and 2), changing the shape of the spring 208 by application of the transversely oriented force releases the springs 206 of the spring clamp unit 200. The springs 206 of the spring clamp unit 200 force the clamp element 204 away from the luminaire assembly 102 (e.g., away from the center of the luminaire assembly 102 or away from the light generating device(s) of the luminaire assembly 102) responsive to the spring 208 of the spring lock unit 202 being bent. For example, the springs 206 of the spring clamp unit 200 can force an outer end 218 of the clamp element 204 to move downward and outward along an arcuate path 220.

Figure 3:
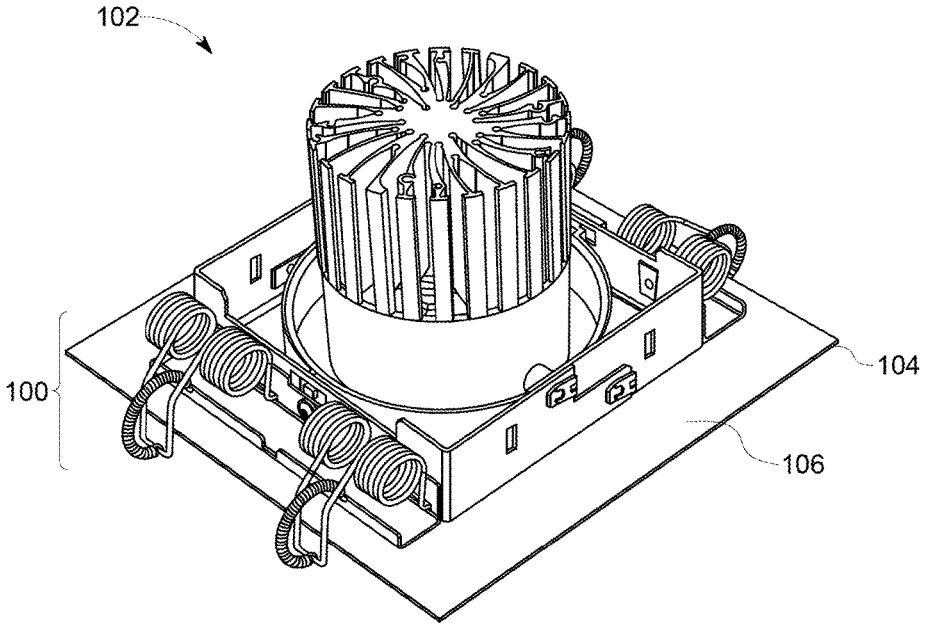
FIG. 3 illustrates a perspective view of one embodiment of the retainer apparatuses shown in FIGS. 1 and 2 in the locked state or position.
Figure 4:
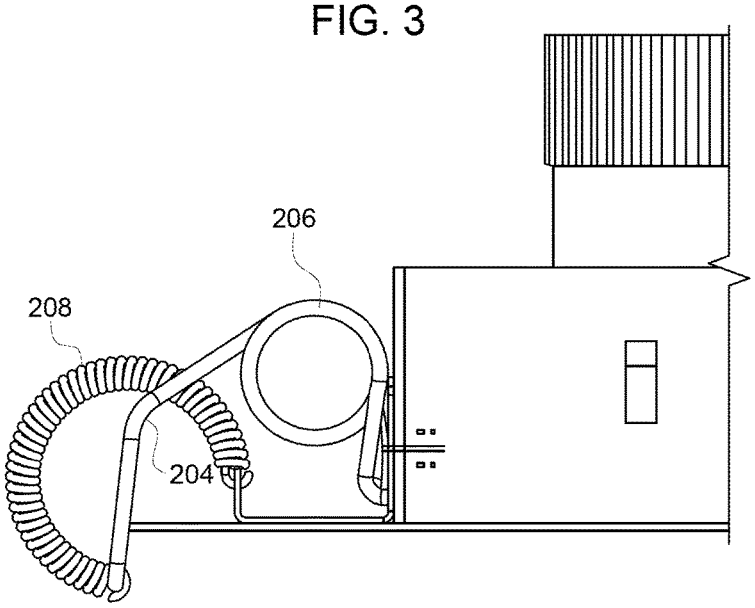
FIG. 4 illustrates a side view of one of the retainer apparatuses shown in FIG. 1 in the locked state or position.

FIG. 3 illustrates a perspective view of one embodiment of the retainer apparatuses 100 shown in FIGS. 1 and 2 in the locked state or position. FIG. 4 illustrates a side view of one of the retainer apparatuses 100 in the locked state or position. Application of the transversely oriented force onto the spring 208 of the spring lock unit 202 while in the released position reduces the ability of the spring 208 to remain compressed between the outer end 218 of the clamp unit 204 and the frame portion 104 of the luminaire assembly 102. This force can at least slightly bend the spring 208 inward, which can weaken the ability of the spring 208 to prevent the springs 206 of the spring clamp unit 200 from remaining in the coiled or energized state. The springs 206 may be released from the coiled state and force the clamp element 204 to move along the path 220 shown in FIG. 2.

This movement causes the clamp element 204 to laterally extend outward, as shown in FIGS. 3 and 4. As described below, the clamp element 204 may engage an upper surface of a panel in which the luminaire assembly 102 is placed to secure the luminaire assembly 102 into a cutout in the panel. The movement of the clamp element 204 outward and downward transitions the retainer apparatus 100 to the locked state or position shown in FIG. 4.

Figure 5:
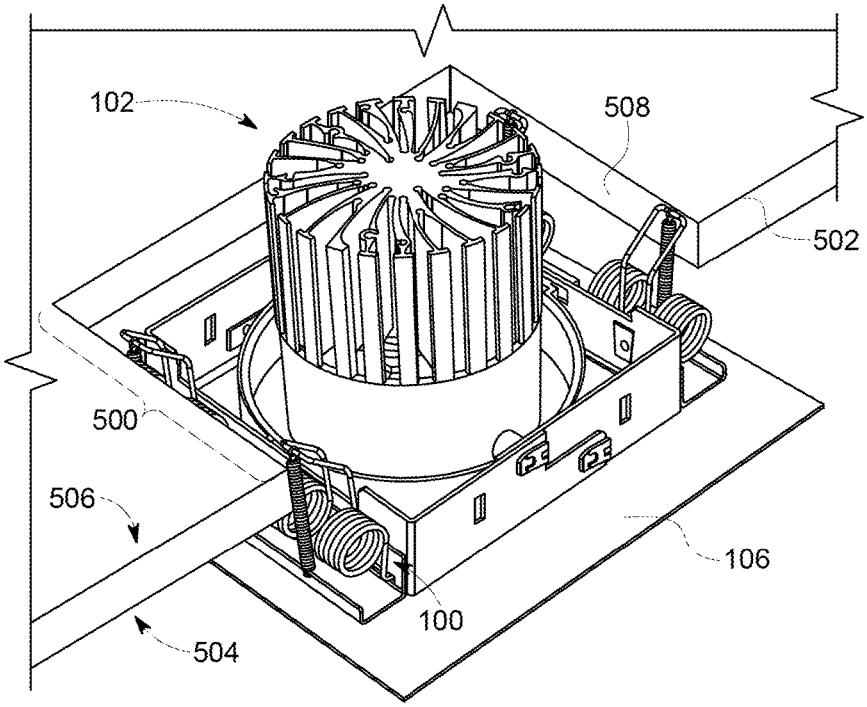
FIG. 5 illustrates a cut-away view of installation of the luminaire assembly into a cutout of a panel according to one example.
Figure 6:
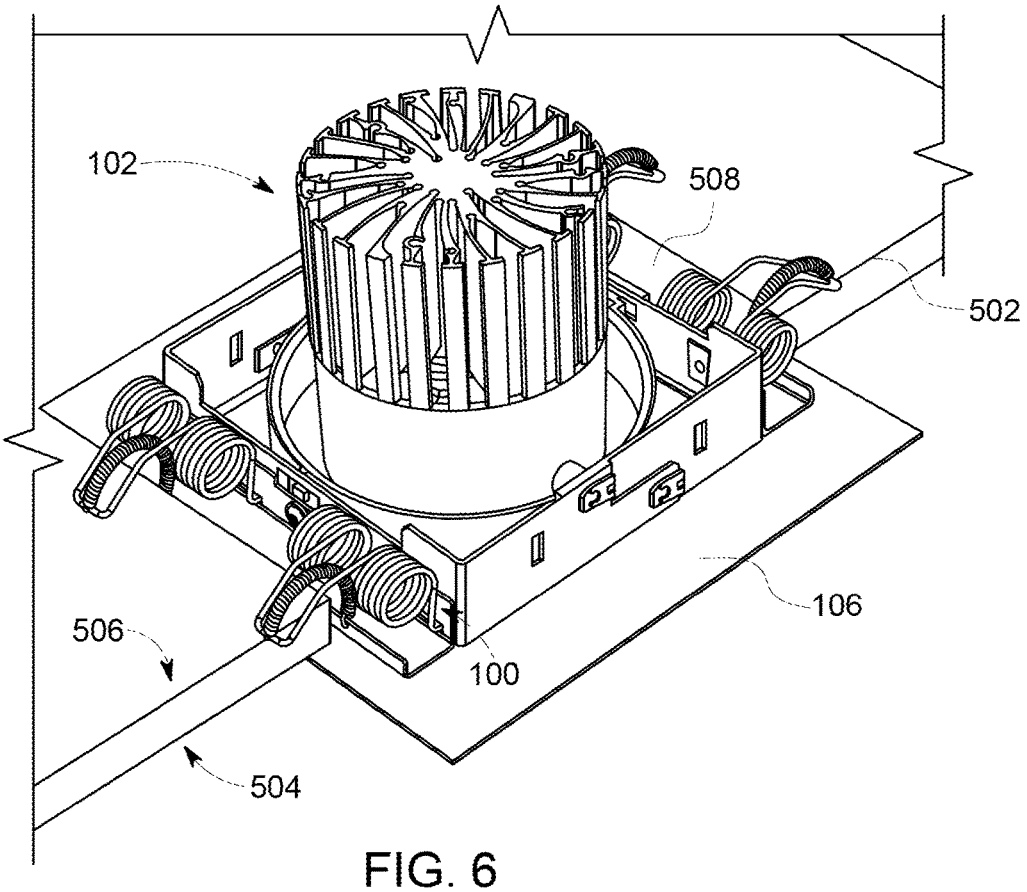
FIG. 6 illustrates another cut-away view of installation of the luminaire assembly into a cutout of a panel according to one example.

FIGS. 5 and 6 illustrate cut-away views of installation of the luminaire assembly 102 into a cutout 500 of a panel 502 according to one example. The panel 502 can represent a ceiling or other planar surface having an opening (e.g., the cutout 500) into which the luminaire assembly 102 is to be installed. The panel 502 has an outer or lower surface 504 from which the light generated by the luminaire assembly 102 will be visible and an opposite upper or hidden surface 506. The surface 504 of the panel 502 may be visible to a viewer of the light emitted by the luminaire assembly 102 while the surface 506 may not be visible to such a viewer.

The retainer apparatuses 100 are in the locked position prior to installing the luminaire assembly 102 into the cutout 500 of the panel 502. The retainer apparatuses 100 may be placed into the locked position or state (from the released position or state) by pushing upward and/or inward on the outer ends 218 of the clamp elements 204 (shown in FIG. 2)

until the spring 208 of the lock spring unit 202 (also shown in FIG. 2) is straightened to a point where the compression of the spring 208 by the springs 206 of the spring clamp unit 200 (also shown in FIG. 2) prevents the same springs 206 from moving the clamp element 204 outward and downward, as described above.

As shown in FIG. 5, the retainer apparatuses 100 are sufficiently far back or receded to allow the luminaire assembly 102 to be at least partially inserted into the cutout 500. As the luminaire assembly 102 with the retainer apparatuses 100 are inserted into the cutout 500, one or more edges 508 of the cutout 500 may engage the springs 208 of the lock spring units 202 of the retainer apparatuses 100. The edges 508 may be surfaces that extend from one surface or side 504 or 506 of the panel 502 to the opposite surface or side 506 or 504 of the panel 502. During movement of the luminaire assembly 102 up into the cutout 500 in the panel 502, the edges 508 can engage the springs 208 of the lock spring units 202 in directions that are transversely oriented to the lengths of the springs 208. Optionally, the person installing the luminaire assembly 102 can laterally move the luminaire assembly 102 in the cutout 500 to cause one or more of the edges 508 to engage the springs 208 of the lock spring units 202 along directions that are transversely oriented with respect to the lengths of the springs 208.

As described above, this can cause the springs 208 to bend and allow the springs 206 of the spring clamp units 200 to move the clamp elements 204 downward toward the upper surface 506 of the panel 502, as shown in FIG. 6. The springs 206 also move the clamp elements 204 outward so that the clamp elements 204 are laterally oriented in the locked position or state shown in FIG. 6.

The springs 206 of the spring clamp units 200 of the retainer apparatuses 100 can continue to apply a force on the outer end of the clamp elements 204. This force can secure the luminaire assembly 102 to the panel 502 within the cutout 500. For example, the trim frame portion 106 of the housing 104 of the luminaire assembly 102 may engage the lower surface 504 of the panel 502, with the springs 206 of the spring clamp units 200 applying forces that push downward on the upper surface 506 of the panel 502. This can force and continue to apply a force to the trim frame portion 106 of the housing 104 of the luminaire assembly 102 up against the lower surface 504 of the panel 502.

The spring clamp units 200 can provide the force onto the clamp element 204 can provide the force over a relatively large range of distances. This can permit the retainer apparatuses 100 to secure the luminaire assembly 102 in cutouts 500 of panels 502 having a wide range of thicknesses.

Figure 7:
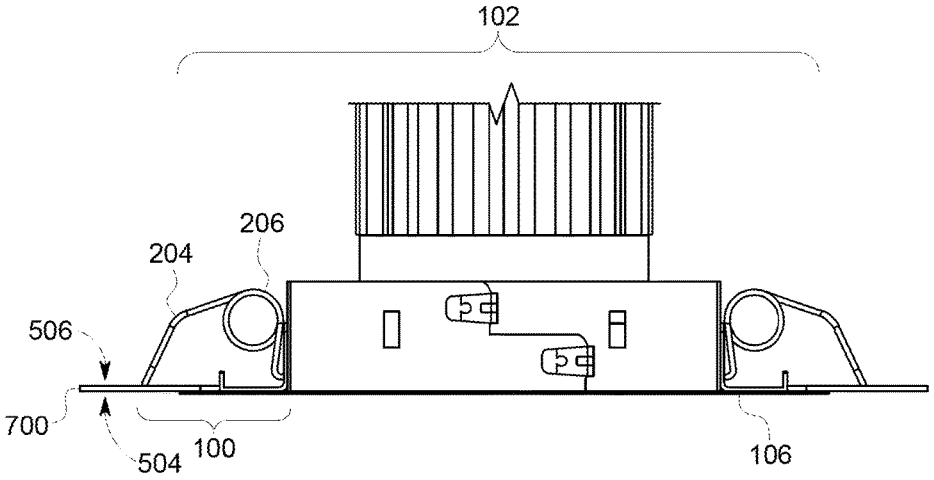
FIG. 7 illustrates the retainer apparatuses securing the luminaire assembly in a cutout of a panel having a small thickness according to one embodiment.
Figure 8:
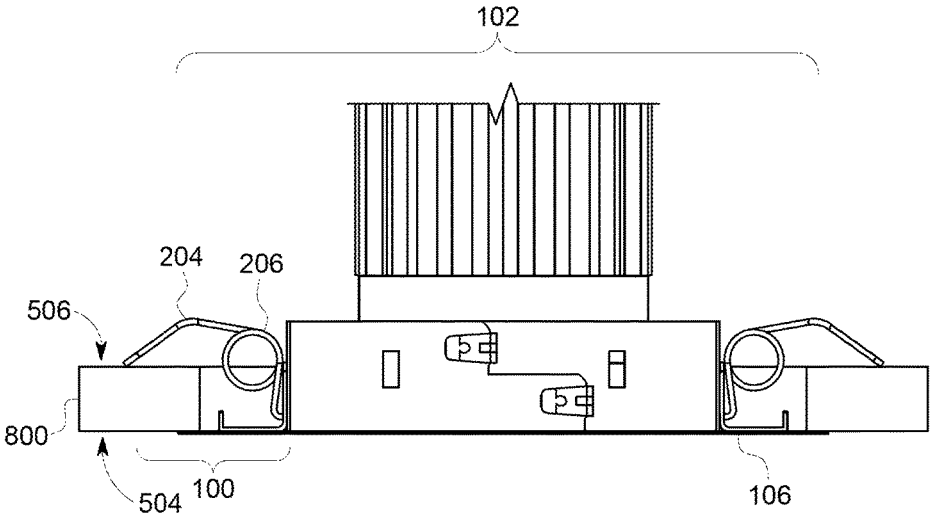
FIG. 8 illustrates the retainer apparatuses securing the luminaire assembly in a cutout of a panel having a medium thickness according to one embodiment.
Figure 9:
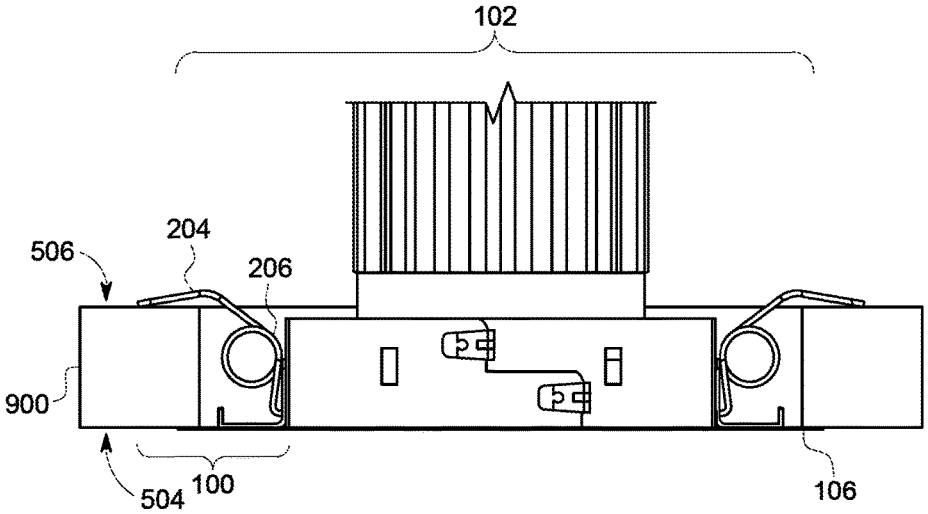
FIG. 9 illustrates the retainer apparatuses securing the luminaire assembly in a cutout of a panel having a large thickness according to one embodiment.

FIGS. 7 through 9 illustrate the retainer apparatuses 100 securing the luminaire assembly 102 in cutouts 500 of panels 700, 800, 900 of a variety of different thicknesses according to one or more embodiments. As shown in FIGS. 7 through 9, the spring clamp units 200 can move the clamp elements 204 to engage the upper surfaces of the panels 700, 800, 900 over a wide range of panel thicknesses. This can allow for the retainer apparatuses 100 to be used in securing the luminaire assemblies 102 in a wide variety of panels.

Figure 10:
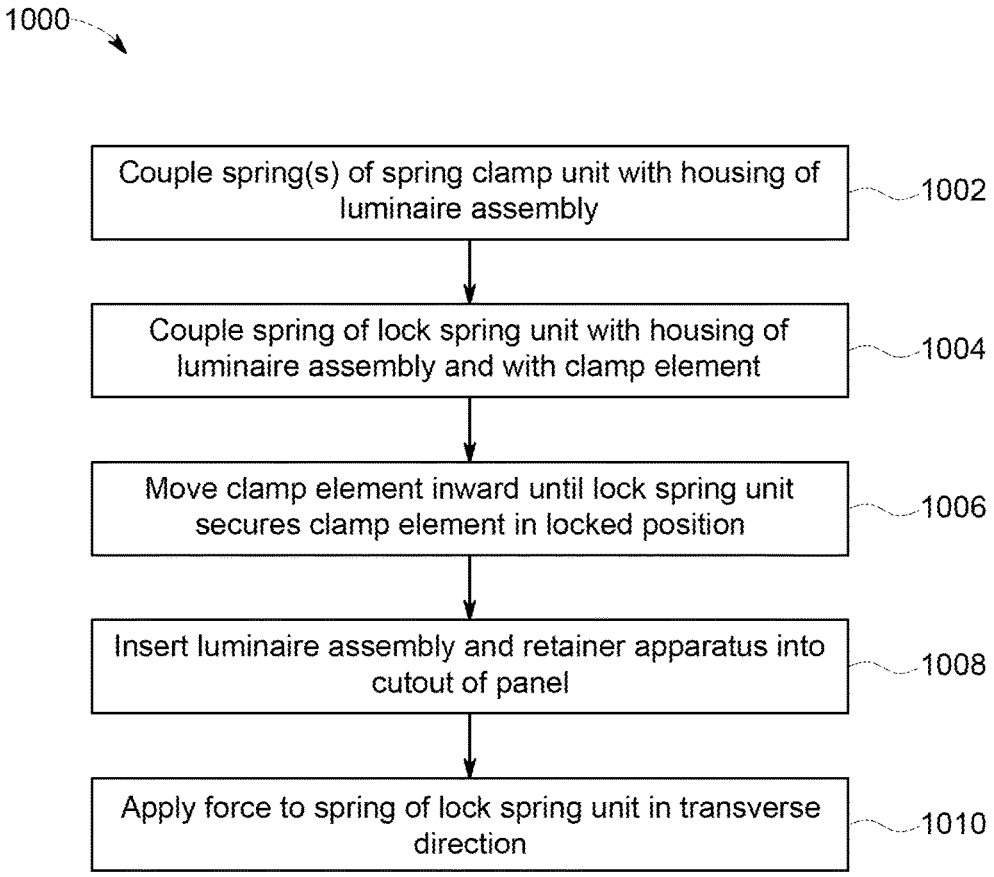
FIG. 10 illustrates a flowchart of one embodiment of a method for providing a luminaire assembly with retainer apparatuses.

FIG. 10 illustrates a flowchart of one embodiment of a method 1000 for providing a luminaire assembly with retainer apparatuses. The method 1000 may be used to provide the retainer apparatuses 100 for a recessed luminaire assembly. At 1002, one or more springs 206 of the spring clamp unit 210 are coupled with the housing 104 of the luminaire assembly 102. The springs 206 can be connected with the clamp element 204. At 1004, the spring 208 of the spring lock unit 202 is coupled with the housing 104 of the luminaire assembly 102 and with the outer end 218 of the clamp element 204. The spring 208 may be coupled with the housing 104 and the clamp element 204 to prevent the springs 206 from moving the clamp element 204 outward and laterally outward unless or until a force is applied to the spring 208 in a direction that is transverse to the length of the spring 208.

At 1004, the clamp element is moved inward and toward a vertical orientation until the spring of the lock spring unit secures the clamp element in the locked position or state. At 1006, the luminaire assembly with the retainer apparatus(es) is inserted into a cutout of a panel. At 1008, a force is applied to the spring of the lock spring unit in a direction that is transverse to the length of this spring. The force can be applied by the edges of the panel in the cutout engaging the springs 208 of the spring lock unit 202 and/or by an operator applying the force with his or her fingers or optionally a tool. This force can at least partially bend this spring and allow the springs of the spring clamp unit to move the clamp element laterally outward and down toward the upper surface of the panel. The retainer apparatuses 100 then secure the luminaire assembly 102 to the panel in the cutout in the panel.

One or more embodiments of the inventive subject matter described herein allow for recessed luminaire assemblies to be installed easily in a very short time independent of the thickness of the ceiling panel. Reduced effort is required for installing the luminaire assemblies 102, and no additional tools are needed for the installation. The time needed to install the luminaire assemblies 102 is independent from the thickness of the ceiling panel thickness as the retainer apparatuses 100 can easily adapt to a wide range of panel thicknesses.

While only certain features of the invention have been illustrated and described herein, many modifications and changes will occur to those of ordinary skill in the art. It is, therefore, to be understood that the appended claims are intended to cover all such modifications and changes as fall within the true spirit of the inventive subject matter described herein.

What is claimed is:

1. A retainer apparatus for a luminaire assembly, the retainer apparatus comprising:

a spring clamp unit including a clamp element and one or more first springs, the one or more first springs coupled with the clamp element and the luminaire assembly; and a lock spring unit comprising a second spring coupled with the luminaire assembly and the clamp element, wherein the second spring of the lock spring unit secures the clamp element in a released position and, responsive to actuation of the second spring, the one or more first springs move the clamp element from the released position to a locked position to secure the luminaire assembly into a recess; and wherein the second spring of the lock spring unit transitions from an elongated shape in the released position of the clamp element to a bent shape in the locked position.

2. The retainer apparatus of claim 1, wherein the one or more first springs are secured in a compressed state by the second spring when the clamp element is in the released position.

3. The retainer apparatus of claim 1, wherein the one or more first springs are one or more torsional coil springs.

4. The retainer apparatus of claim 1, wherein the second spring is an extension spring.

5. The retainer apparatus of claim 1, wherein the second spring of the lock spring unit is actuated by application of a transversely oriented force to the second spring.

6. The retainer apparatus of claim 1, wherein the one or more first springs pivot the clamp element away from the luminaire assembly responsive to actuation of the second spring.

7. The retainer apparatus of claim 1, wherein the clamp element is oriented in a vertical direction in the released position and the clamp element is oriented in a lateral direction in the locked position.

8. A retainer apparatus comprising:

a clamp element extending between one or more hook ends and an opposite outer end; one or more first springs coupled with the one or more hook ends of the clamp element and with a housing of a luminaire assembly; and a second spring coupled with the housing of the luminaire assembly and with the outer end of the clamp element, wherein the second spring secures the clamp element in a released position and, responsive to actuation of the second spring, the one or more first springs pivot the clamp element from the released position to a locked position to secure the luminaire assembly into a recess and wherein the second spring transitions from an elongated shape in the released position of the clamp element to a bent shape in the locked position.

9. The retainer apparatus of claim 8, wherein the one or more first springs are secured in a compressed state by the second spring when the clamp element is in the released position.

10. The retainer apparatus of claim 8, wherein the one or more first springs are one or more torsional coil springs.

11. The retainer apparatus of claim 8, wherein the second spring is an extension spring.

12. The retainer apparatus of claim 8, wherein the second spring is actuated by application of a transversely oriented force to the second spring.

13. The retainer apparatus of claim 8, wherein the one or more first springs pivot the clamp element away from the luminaire assembly responsive to actuation of the second spring.

14. The retainer apparatus of claim 8, wherein the clamp element is oriented in a vertical direction in the released position and the clamp element is oriented in a lateral direction in the locked position.

15. A method comprising:

coupling one or more first springs with a housing of a luminaire assembly, the one or more first springs connected with one or more hook ends of a clamp element;

coupling a second spring with the housing of the luminaire assembly and with an outer end the clamp element, wherein the second spring is coupled with the housing and with the clamp element such that the second spring secures the clamp element in a released position and such that, responsive to actuation of the second spring, the one or more first springs pivot the clamp element from the released position to a locked position to secure the luminaire assembly into a recess; and wherein the one or more first springs include plural first springs located on opposite sides of the clamp element, and wherein coupling the second spring with the housing of the luminaire assembly includes coupling one end of the second spring with the housing in a location that is between the plural first springs.

16. The method of claim 15, wherein the one or more first springs are coupled with the housing of the luminaire assembly in a compressed state.

17. The method of claim 15, wherein the second spring is coupled with the housing of the luminaire assembly such that the second spring is compressed by the one or more first springs between the outer end of the clamp element and the housing of the luminaire assembly.

* * * * *